US006106416A

United States Patent [19]

Ward

[11] Patent Number: 6,106,416

[45] Date of Patent: Aug. 22, 2000

[54] SPONGE BALL GAME

[76] Inventor: Daniel K. Ward, 275 Murphy La., Grants Pass, Oreg. 97527

[21] Appl. No.: 09/174,360

[22] Filed: Oct. 15, 1998

[51] Int. Cl.[7] ..... A63B 67/00

[52] U.S. Cl. ..... 473/465; 473/468; 473/567; 473/454

[58] Field of Search ..... 473/465, 468, 473/454, 567; 273/317.6, 317.7, 317.8, 317.9

[56] References Cited

U.S. PATENT DOCUMENTS

| | | | |
|---|---|---|---|
| 3,830,497 | 8/1974 | Peterson | 473/468 |
| 3,923,304 | 12/1975 | Warren | 473/516 |
| 4,343,467 | 8/1982 | Newcomb et al. | 473/567 |
| 4,546,976 | 10/1985 | Jones | 473/567 |
| 4,705,273 | 11/1987 | Ament et al. | 473/567 |
| 4,781,385 | 11/1988 | Harley | 473/468 |
| 5,562,289 | 10/1996 | McAllister | 473/468 |

*Primary Examiner*—Mark S. Graham

[57] ABSTRACT

A sponge ball game system including a playing field with a plate having a front edge and parallel side edges and angled rear edges. The playing field includes linear foul lines with arcuate lines therebetween. The arcuate lines include a pitching/base hit line, a double line and a home run line. The field also has two rectangular batting boxes on opposite sides of the plate.

4 Claims, 2 Drawing Sheets

SPONGE BALL GAME

BACKGROUND OF THE INVENTION

1. Field of the Invention

The present invention relates to a sponge ball game system and more particularly pertains to playing a baseball-like game for entertainment and exercise.

2. Description of the Prior Art

The use of ball games of known designs and configurations is known in the prior art. More specifically, ball games of known designs and configurations heretofore devised and utilized for the purpose of playing games with balls, bats and the like through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,941,662 to DePerna discloses a Baseball Game. U.S. Pat. No. 4,522,396 to Girard et al. discloses a Game Ball. U.S. Pat. No. 5,211,394 to Jackson et al. discloses a Baseball Hitting Game. U.S. Pat. No. 4,343,467 to Newcomb et al. discloses a Short Hitting Baseball Bat. U.S. Pat. No. 4,705,273 to Ament et al. discloses a Cushioned Bat. Lastly, U.S. Pat. No. Des. 322,288 to Coleman discloses a Baseball Pitching Target.

In this respect, the sponge ball game system according to the present invention substantially departs from the conventional concepts and designs of the prior art, and in doing so provides an apparatus primarily developed for the purpose of playing a baseball-like game for entertainment and exercise.

Therefore, it can be appreciated that there exists a continuing need for a new and improved a sponge ball game system which can be used for playing a baseball-like game for entertainment and exercise. In this regard, the present invention substantially fulfills this need.

SUMMARY OF THE INVENTION

In view of the foregoing disadvantages inherent in the known types of ball games of known designs and configurations now present in the prior art, the present invention provides an improved a sponge ball game system. As such, the general purpose of the present invention, which will be described subsequently in greater detail, is to provide a new and improved a sponge ball game system and method which has all the advantages of the prior art and none of the disadvantages.

To attain this, the present invention essentially comprises a new and improved sponge ball game system for playing a baseball-like game for entertainment and exercise comprises a playing field with a plate having a front edge, parallel side edges and angled rear edges at about 70 degrees. The playing field has linear foul lines at about 70 degrees with arcuate lines therebetween. The arcuate lines include a pitching/base hit line about 25–28 feet from the plate, a double line about forty feet from the plate and a home run line about fifty-five feet from the plate. The field also has two rectangular batting boxes on opposite sides of the plate. Also provided is a bat between about twenty-four and thirty-one inches in length and having a Schedule 80 polyvinylchloride cylindrical core with wrapped foam therearound. The foam having a thick cylindrical hitting end and a thin cylindrical handle end with a tapering transition zone 48 therebetween. Also provided is a ball about three inches in diameter fabricated of a soft sponge-like material with simulated stitching lines therearound. A target is positioned behind the plate and is fabricated of plywood between about ½ and ⅝ inches in thickness with a height of about 20 inches and a width of about 14 inches. A cylindrical container for weighting purposes is positionable in the ground to support the target behind the plate with a post between the target and container to position the bottom of the target about 20 inches above the ground.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved a sponge ball game system which has all of the advantages of the prior art ball games of known designs and configurations and none of the disadvantages.

It is another object of the present invention to provide a new and improved a sponge ball game system which may be easily and efficiently manufactured and marketed.

It is further object of the present invention to provide a new and improved a sponge ball game system which is of durable and reliable constructions.

An even further object of the present invention is to provide a new and improved a sponge ball game system which is susceptible of a low cost of manufacture with regard to both materials and labor, and which accordingly is then susceptible of low prices of sale to the consuming public, thereby making such a sponge ball game system economically available to the buying public.

Even still another object of the present invention is to provide a sponge ball game system for playing a baseball-like game for entertainment and exercise.

Lastly, it is an object of the present invention to provide a new and improved sponge ball game system including a playing field with a plate having a front edge and parallel side edges and angled rear edges. The playing field includes linear foul lines with arcuate lines therebetween. The arcuate lines include a pitching/base hit line, a double line and a home run line. The field also has two rectangular batting boxes on opposite sides of the plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
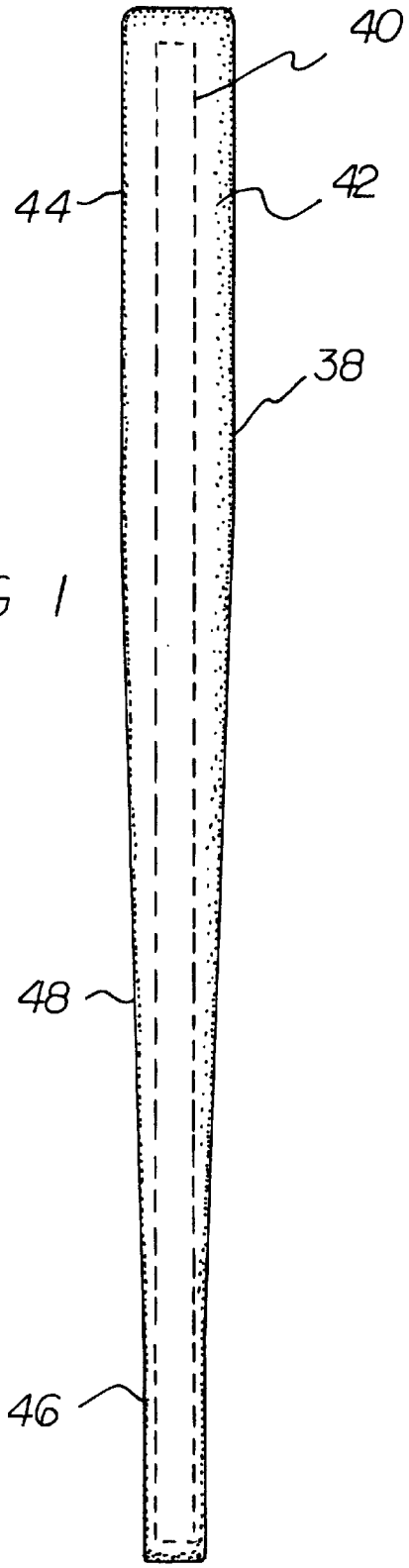
FIG. 1 is a front elevational view of the preferred embodiment of the sponge ball game system constructed in accordance with the principles of the present invention.
Figure 2:
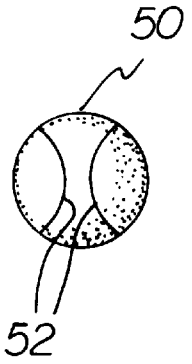
FIG. 2 is a ball fabricated for use in association with the bat of FIG. 1.
Figure 3:
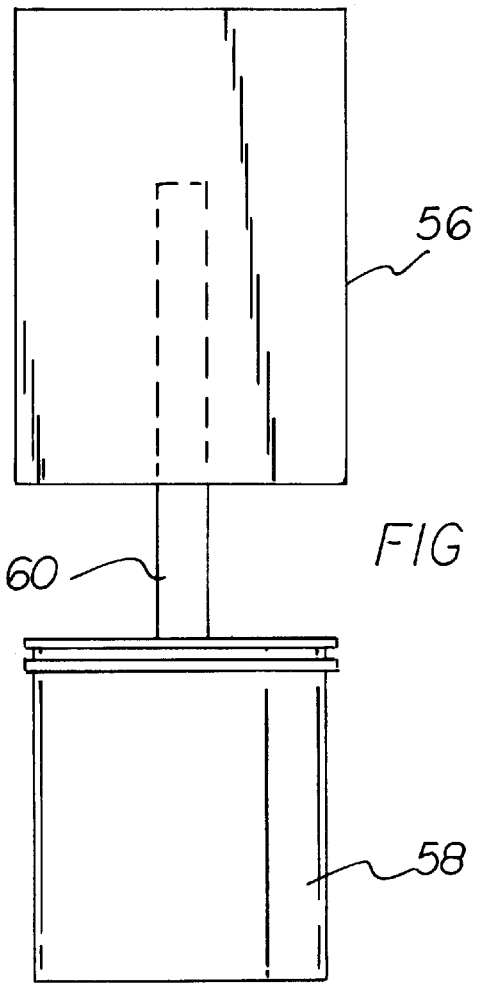
FIG. 3 is a front elevational view of a target adapted to be used in association with the ball and bat shown in FIGS. 1 and 2.
Figure 4:
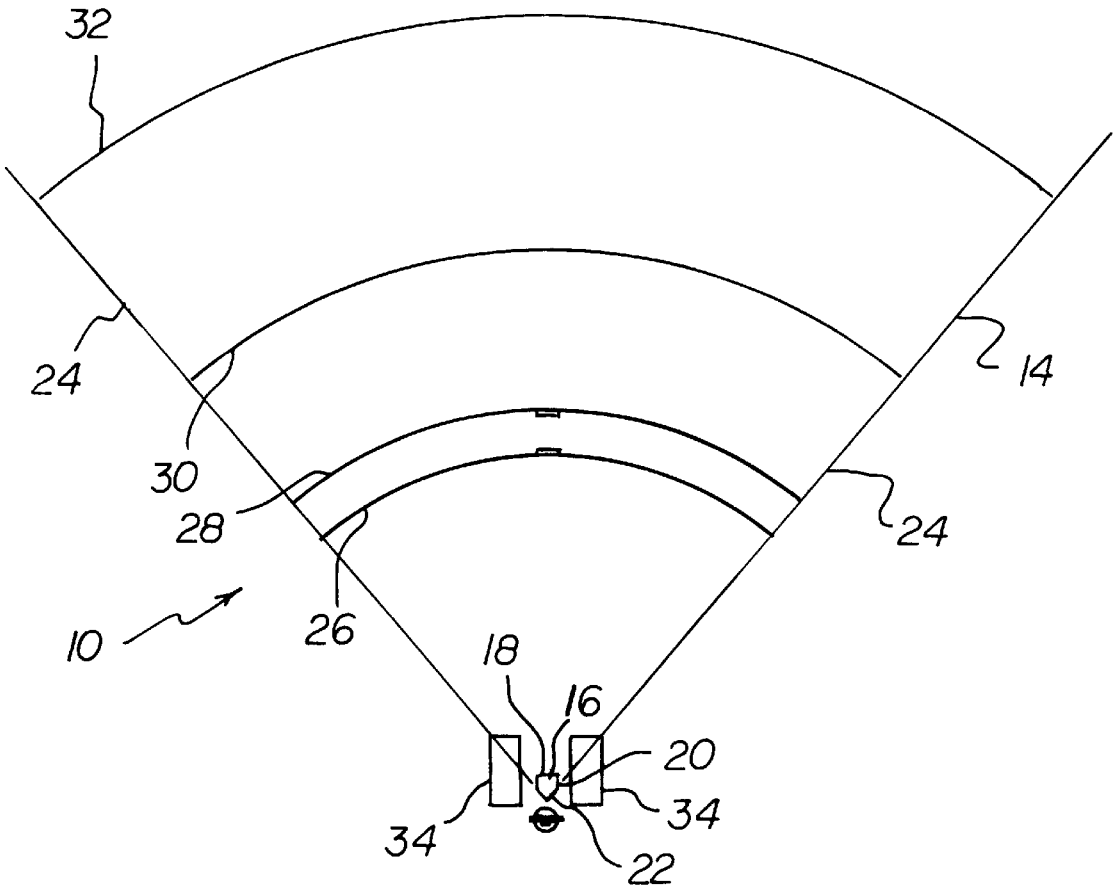
FIG. 4 is an elevational view of a playing field for use in association with the ball, bat and target of the prior Figures.

With reference now to the drawings, and in particular to FIG. 1 thereof, the preferred embodiment of the new and improved a sponge ball game system embodying the principles and concepts of the present invention and generally designated by the reference numeral 10 will be described.

The present invention, the sponge ball game system 10 is comprised of a plurality of components. Such components are individually configured and correlated with respect to each other so as to attain the desired objective.

The new and improved sponge ball game system for playing a baseball-like game for entertainment and exercise comprises a playing field 14 with a plate 16 having a front edge 18, parallel side edges 20 and angled rear edges 22 at about 70 degrees. The playing field has linear foul lines 24 at about 70 degrees with arcuate lines therebetween. The arcuate lines include a pitching/base hit line located between about 25 feet (shown as numeral 26) and 28 feet (shown as numeral 28) from the plate. The exact distance is dependent on an age of players who are participating in the game of the present invention. A double line 30 is located about forty feet from the plate and a home run line 32 is located about fifty-five feet from the plate. The field also has two rectangular batting boxes 34 on opposite sides of the plate.

Also provided is a bat 38 between about twenty-four and thirty-one inches in length and having a Schedule 40 polyvinylchloride cylindrical core 40 with wrapped foam 42 therearound. Preferably, the PVC core has a length of either 29 or 30 inches. The foam having a thick cylindrical hitting end 44 and a thin cylindrical handle end 46 with a tapering transition zone 48 therebetween. The foam has a thickness of between ⅜ to ½ inches.

Also provided is a ball 50 about three inches in diameter fabricated of a soft sponge-like material with simulated stitching lines 52 therearound.

A target 56 is positioned behind the plate and is fabricated of plywood between about ½ and ⅝ inches in thickness with a height of about 20 inches and a width of about 14 inches. A 3 or 5 gallon cylindrical container 58 for weighting purposes is positionable in the ground to support the target behind the plate with a post 60 between the target and container to position the bottom of the target about 20 inches above the ground.

Instructions for making the target of the system of the present invention include: (a) dimensioning the target at about 14 inches wide by 20 long, (b) using an existing wall marked 19 or 20 inches from the ground, this should be where the bottom of the target should be located and thereafter securing the target at corners in the middle, (c) using a three or five-gallon bucket, cut a 2×4 to three foot lengths and plywood 14 inches wide and 20 inches high and center the plywood to the top of the 2×4, (d) place some nails into the bottom of the bucket to help hold the cement and then pour the cement into the bucket, and (e) place the 2×4 with nails into the bucket, making sure that the target is still 20 inches from the ground, and slightly tilted backwards.

For making the field (a) mow the yard to the highest setting on the lawn mower and put down home plate where desired, (b) step off 8 large steps or exactly 25 feet and put down the pitchers mound, (c) from the pitchers mound, step off 5 large steps or 15 feet to make the 40 ft line from home plate, (d) for the base lines, step off 8 large steps or 24 ft. turning slightly and marking the 3rd, 6th and 8th steps. Note that home plate, base hit line and double line markers should line up as straight as possible.

For making the field: (a) Mow lawn at highest setting. (b) with 10 to 12 markers in hand (sticks, hats, shoes, etc.) put down home plate in desired place. (c) From home plate, step off 8 large steps, or exactly 25 ft. towards pitchers mound. Put down marker, then take 5 large steps or 6 large steps to the home run line and put down marker. From pitchers mount, take 5 large steps toward $1^{st}$ base turning inward slightly, dropping markers every other step. Do the same for $3^{rd}$ base side, double and home run lines. Foul lines should be as straight as possible using the home plate to line up lines. Adjust all markers by sight and then mow.

For playing the game: (a) pitch the ball toward the target for a strike, the sound it makes is undeniably heard by everyone, (b) for batting the ball, stand in the batters box next to the plate and hit the ball, (c) fielding the ball requires catching the ball hit by the batter.

The rules of the game include pitching the ball toward the target area allowing for 4 balls for a walk and 3 strikes for an out. Hitting the batter is only ruled a ball. Dropping the ball while pitching is only ruled a ball. A foul tip 3rd strike that hits the target is an out (as if caught by the catcher).

A batted ball must pass at least the base hit line for a safe hit. A batted ball must also pass the required lines for extra base hits (double line over home run line). A batted ball that stops in front of the base hit line is an out. Any fly ball caught that does not touch the ground is an out. A ground ball must be fielded before it passes the base hit line or it is ruled an out.

Errors occur when a grounder, fielded by the infield is not caught when first touched. (No bobbles whatsoever). Even if a ball bounces off a fielder's hand but does not touch the ground it is ruled an error and the runners advance. If a line drive hits the pitcher and falls to the ground but does not pass the base hit line, it is ruled a hit or an error.

The defensive team can knock down or stop a ball from passing a line but not field it and save an extra base. For example, a ground hit hard enough to pass the double line can be stopped, or knocked down, so it does not pass it and then it is only ruled a single.

The basic rules of the game include no umpires, no running, no hit batters, no stealing bases, no advanced rules, no double plays, no sacrifices, fly ball outs, runners do not advance ever, force outs are always the lead runner.

The appealing features of the present system are its ability to provide hours of fun and entertainment for a product that allows a group of players to have fun playing baseball in the backyard. Baseball is played with a hard, leather-covered ball that flies fast and travels great distances when struck by a wood or aluminum bat. Space restrictions prevent a baseball game from being played in most neighborhoods since the ball may damage a house or a car.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new and improved a sponge ball game system for playing a baseball-like game for entertainment and exercise comprising, in combination:

a playing field with a plate having a front edge and parallel side edges and angled rear edges at about 70 degrees, the playing field having linear foul lines at about 70 degrees with arcuate lines therebetween, the arcuate lines including a pitching/base hit line about 25–28 feet from the plate, a double line about forty feet from the plate and a home run line about fifty-five feet from the plate, the field also having two rectangular batting boxes on opposite sides of the plate;

a bat being between about twenty-four and thirty-one inches in length, the bat having a Schedule 80 polyvinylchloride cylindrical core with wrapped foam therearound, the foam having a thick cylindrical hitting end and a thin cylindrical handle end with a tapering transition zone therebetween;

a ball about three inches in diameter fabricated of a soft sponge-like material with simulated stitching lines therearound; and a target positionable behind the plate, the target being fabricated of plywood between about ½ and ⅝ inches in thickness with a height of about 20 inches and a width of about 14 inches, a cylindrical container for weighting purposes positionable in the ground to support the target behind the plate with a post between the target and container to position the bottom of the target about 20 inches above the ground.

2. A sponge ball game system for playing a baseball-like game for entertainment and exercise comprising, in combination:

a playing field with a plate having a front edge and parallel side edges and angled rear edges, the playing field having linear foul lines at about 70 degrees with arcuate lines therebetween, the arcuate lines including a pitching/base hit line about 25–28 feet from the plate a double line about forty feet from the plate and a home run line about fifty-five feet from the plate;

a bat being between about twenty-four and thirty-one inches in length, the bat having a polyvinylchloride core with foam wrapped therearound, the foam having a relatively thicker cylindrical hitting end and a relatively thinner cylindrical handle end with a tapering transition zone therebetween;

a ball fabricated of a soft sponge-like material; and a target positionable behind the plate, the target having a height of about 20 inches and a width of about 14 inches, a container for weighting purposes positionable in the ground to support the target behind the plate with a post between the target and container to position the bottom of the target ab out 20 inches above the ground.

3. A ball game system as set forth in claim 2 wherein the field also has two rectangular batting boxes on opposite sides of the plate.

4. The ball game system as claimed in claim 2 wherein the target has a rectangular shape and the container supports the target in a vertical plane.

* * * * *